US005203361A

United States Patent [19]

Tickle

[11] Patent Number: 5,203,361

[45] Date of Patent: Apr. 20, 1993

[54] RECREATIONAL VEHICLE HOLDING TANK HOSE CLEANING

[75] Inventor: David P. Tickle, Summerfield, N.C.

[73] Assignee: Camco Manufacturing, Inc., Greensboro, N.C.

[21] Appl. No.: 772,267

[22] Filed: Oct. 7, 1991

[51] Int. Cl.[5] ..... B08B 9/02

[52] U.S. Cl. ..... 134/167 C

[58] Field of Search ..... 134/152, 166 C, 167 C, 134/168 C, 169 C, 900; 239/271; 141/392; 138/106, 107, 108, 112, 114; 15/395, 405, 406

[56] References Cited

U.S. PATENT DOCUMENTS

| | | | |
|---|---|---|---|
| 2,993,650 | 7/1961 | Badberg | 239/271 |
| 3,426,774 | 2/1969 | Conn | 134/166 C |
| 4,054,149 | 10/1977 | Nelson | 134/167 C |
| 4,406,434 | 9/1983 | Schneckloth | 248/83 |
| 4,587,994 | 5/1986 | Links et al. | 138/89 |
| 4,615,501 | 10/1986 | Pesold | 248/75 |
| 4,702,267 | 10/1987 | Ashraff | 239/271 X |
| 4,941,629 | 7/1990 | Horn | 248/62 |

FOREIGN PATENT DOCUMENTS

| | | | |
|---|---|---|---|
| 0677753 | 8/1979 | U.S.S.R. | 239/271 |

*Primary Examiner*—Philip R. Coe

*Attorney, Agent, or Firm*—Rhodes, Coats & Bennett

[57] ABSTRACT

A cleaning and storage implement for cleaning and storing sewer hoses used to discharge the contents of holding tanks of recreational vehicles. An elongated plastic tube has a length and first and second ends, with a water supply conduit fitting on the first end and a nozzle that sprays in a conical spray pattern on the second end. An adjustable positionable stop on the tube near the first end in the form of a disk has a hole sized so as to receive the tube in an adjustable friction fit. A hand grip on the tube is located between the fitting and the stop, and a retainer hook on the tube is located near the second end. A compressible hose may be cleaned and stored by connecting a cleaning water supply conduit to the first end of the tube, supplying water through the tube from the supply while passing the second end of the tube into a first end of the hose to clean the hose by a spray of water from the nozzle at the second end of the tube. The hose is compressed against the stop, and upon compressing the hose to a length comparable to the distance between the stop and the retainer, the second end of the hose is retained with the retainer hook.

17 Claims, 1 Drawing Sheet

RECREATIONAL VEHICLE HOLDING TANK HOSE CLEANING

BACKGROUND OF THE INVENTION

The present invention relates to implements for assisting in the cleaning and storage of sewer hoses, particularly for use in connection with recreational vehicles.

Recreational vehicles, such as campers, trailers and the like, very often have built in toilet facilities. Included in the toilet facility is a holding tank which holds the waste matter until it can be drained into a sewer or septic system, collectively referred to herein as a sewer. The holding tank is discharged into the sewer through a compressible or collapsible hose which can be fitted to the holding tank and to an inlet for the sewer. In addition to serving in this capacity when the holding tank is to be drained, there are some recreational vehicle parks that have sewer facilities at individual campsites so that the sewer hose can connect the recreational vehicle to the sewer for an extended duration, so that the waste matter need not be held in the holding tank, but passes directly to the hose and into the sewer system.

However, when it is time to leave such a camp or the contents of the holding tank have been emptied into a sewer, some residual waste matter will remain in the hose, so it is desirable that the hose be cleaned out. The hose is generally washed with a water supply such as a garden hose to flush the waste matter out of the hose and into the sewer. Then, the hose is typically compressed and stored in the recreational vehicle, such as in a storage compartment in a recreational vehicle bumper. However, compressing the hose to make it fit in the storage compartment, particularly after it has just been washed, can be a messy process, since the still-wet hose will drip on the person trying to compress it or perhaps spring out of compression while it is to be packed into the storage compartment.

The cleaning of the sewer hose and its compression and packing is commonly considered one of the most distasteful chores in RV camping, and there is a need to improve the processes involved to make them less distasteful and to provide an implement to assist in cleaning and storing the hose.

SUMMARY OF THE INVENTION

The present invention fulfills this need in the art by providing a cleaning and storage implement for cleaning and storing sewer hoses used to discharge the contents of holding tanks of recreational vehicles. The implement includes an elongated tube having a length and first and second ends, with a water supply conduit fitting on the first end and a water outlet on the second end. A stop is located on the tube near the first end and a retainer is located on the tube near the second end.

Thus, a compressible hose may be cleaned and stored by connecting a cleaning water supply conduit to the first end of the tube, supplying water through the tube from the supply while passing the second end of the tube into a first end of a hose to be cleaned to clean the hose with water from the water outlet. While the water flows, or afterward, the hose is compressed against the stop, and upon compressing the hose to a length comparable to the distance between the stop and the retainer, the second end of the hose is retained with the retainer.

Preferably, the tube is a plastic tube, such as polyvinyl chloride. Also preferably, the tube has a hand grip between the fitting and the stop.

In a preferred embodiment, the stop is adjustably positionable, so that the space on the tube for storage of the compressed hose is adjustable to permit compact and snug storage. For example, the stop may be a disk having a hole sized so as to receive the tube in an adjustable friction fit.

Desirably, the water outlet is a nozzle that sprays in a conical spray pattern. The retainer is conveniently in the form of a hook.

The invention also provides a method of cleaning and storing a compressible hose including connecting a cleaning water supply conduit to the first end of a tube, and supplying water from the supply conduit into the first end of the tube while passing the second end of the tube into a hose to be cleaned to clean the hose by a spray of water from a water outlet at the second end of the tube. In the method the water is allowed to rinse the inside of the hose and pass out of one end of the hose. Simultaneously, or subsequently, the hose is compressed against a stop on the tube near the first end. Upon compressing the hose to a length comparable to the distance between the stop and the retainer, the second end of the hose is retained with a retainer on the tube near the second end and the water supply conduit is disconnected from the tube.

In a preferred embodiment the method includes grasping the tube by a hand grip between the fitting and the stop during the supplying, allowing and compressing steps.

The method may also include the preliminary step of adjusting the position of the stop along the length of the tube so that the compressed length of the hose is about the adjusted distance between the stop and the retainer. Such an adjusting step may include adjusting a friction fit of the stop on the tube.

Preferably, the supplying step includes spraying the water in the hose in a conical spray pattern. The retaining step may proceed as the hooking of the second end of the hose on a retainer in the shape of a hook.

The method is advantageously carried out in connection with cleaning and storing a compressible hose which connects a holding tank in a recreational vehicle to a sewer inlet. As such it may include the preliminary step of disconnecting the hose from the holding tank. If the second end of the hose is maintained connected to the sewer inlet, the water passing through the hose in the supplying step may pass directly to the sewer.

BRIEF DESCRIPTION OF THE DRAWINGS

The invention will be better understood from a reading of the Detailed Description of the Preferred Embodiments in conjunction with a review of the drawings in which.

DETAILED DESCRIPTION OF THE PREFERRED EMBODIMENTS

Figure 1:
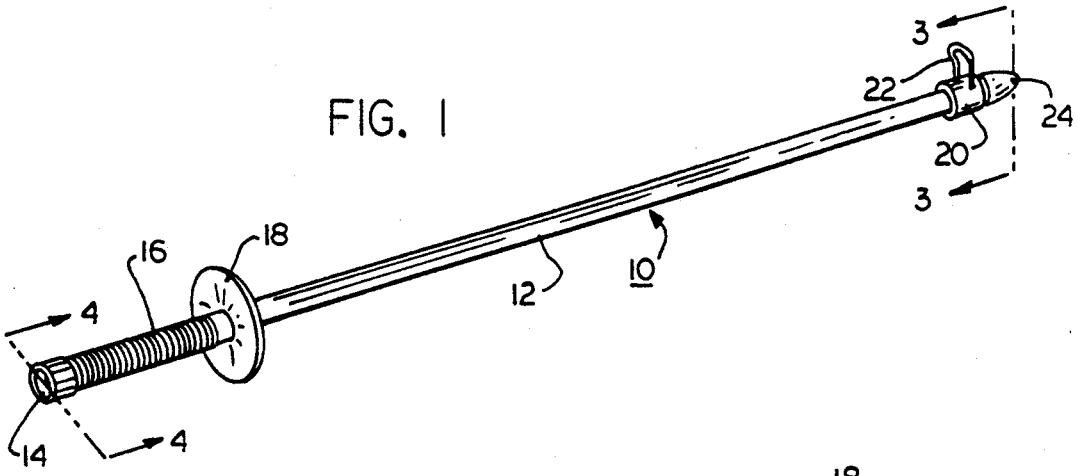
FIG. 1 is an elevation view of the implement of the present invention.
Figure 2:
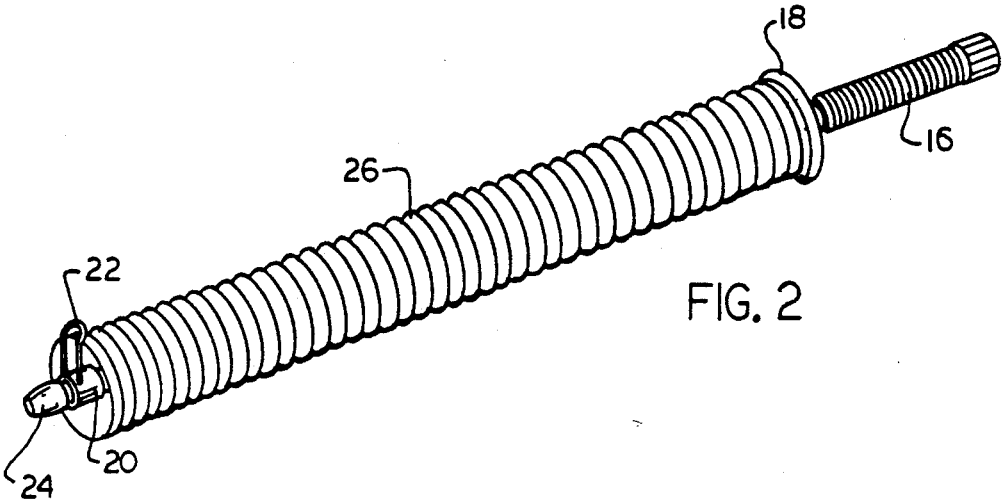
FIG. 2 is an elevation view of the implement of the present invention with a sewer hose compressed thereon.
Figure 3:
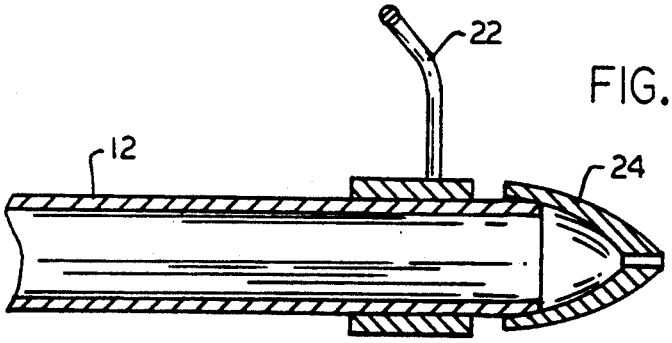
FIG. 3 is sectional view of one end of the implement.
Figure 4:
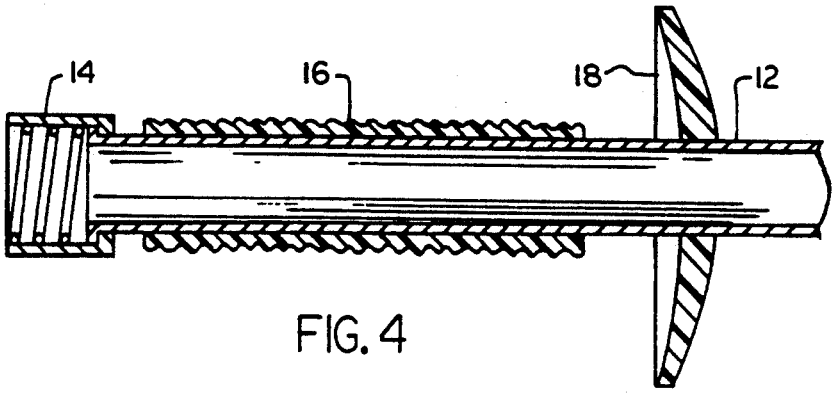
FIG. 4 is sectional view of the other end of the implement.

As can be seen in FIG. 1, the implement 10 of the present invention includes an elongate tube 12. The length of the tube 12 is not critical, but typically is should be about 1/10th the length of the sewer hose to be cleaned and stored. Since sewer hoses are typically up to 20 feet long, at least two feet of storage length on the tube 10 should be provided. In a preferred embodiment, the storage length between the stop 18 and the spray nozzle 24 is 32 inches long.

One end of the tube 12 is provided with a female hose fitting 14 so that the tube can be threaded onto the end of a hose like a garden hose or other water supply conduit. Thus, water can pass through the tube 12 from the fitting 14 to the nozzle 24. A hand grip 16 is conveniently provided on the tube 10 to assist in handling the tube during cleaning and storage operations. A stop 18 is provided next along the length of the tube. It is desirably a Rubber disk 18 having a hole in it with an inside diameter about the same as the outside diameter of the PVC pipe 12, so as to form an adjustable friction fit of the disk along the length of the tube 12. Thus, a user can adjust the position of the stop 18 along the length of the tube 12 as desired to accommodate the length of the compressed sewer hose.

Near the second end of the tube 12, a coupling 20 is located on the outside of the tube 12. In a preferred embodiment, the coupling 20 is an additional piece of PVC tubing with an inner diameter about the same as the outer diameter of the tube 12 and glued in position. The coupling 20 serves as an anchor for a stainless steel retainer 22 in the form of a piece of rod material which forms a hook-type protrusion laterally of the tube 12. The structures of the retainer 22 and coupling 20 are not critical so long as the retainer serves its function of retaining the compressed hose between the retainer and the stop 18.

On the second end of the tube 12 is a nozzle 24, such as a common water spray nozzle which sprays water in a conical pattern, generally coaxial with the tube 12. Other sprays can be used.

The process of the invention and the use of the implement are best exemplified with respect to a recreational vehicle. Thus, a sewer hose 26 which has been connected at one end to a sewer inlet and to the other end to the outlet of a holding tank in a recreational vehicle is to be cleaned and stored. In order to do this, a garden hose or other water supply conduit is connected to the fitting 14 and the water turned on to provide a supply of water spraying out of the nozzle 24. Then, a first end of the hose 26 is disconnected from the recreational vehicle holding tank and the nozzle 24 is introduced into that end of the sewer hose. The water emanating from the nozzle 24 will flush waste matter from the inside of the sewer hose down to the sewer inlet, to which the hose is still connected. As the nozzle 24 is introduced further and further into the hose 26, the first end of the hose abuts the stop 18. The hose is gradually compressed against the stop 18 until the nozzle 24 is adjacent the second end of the hose 26, connected to the sewer inlet. At this point, the hose 26 can be disconnected from the sewer inlet to finish flushing the inside of the hose. Alternatively, the water supply to the fitting 14 can be turned off and the second end of the hose then disconnected. The compression of the hose continues until the second end of the hose passes the retainer 22. The hose 26 is then adjusted laterally of the pipe 12 so that the retainer 22 ensnares the edge of the hose 26 to hold it in compression. The hook shape of the retainer 22 cooperates with the compressed hose 26 to hold the hose in position along the length of the tube 12.

Alternatively, the hose could be completely disconnected from both the holding tank and the sewer and cleaned independently with the spray nozzle 24. Also, the compression of the hose onto the tube 12 for storage between the stop 18 and the retainer 22 may take place only after the washing of the inside of the tube has been completed. This may particularly be desired if the hose is to remain stored for a long period of time, in which case it may be desirable to let the hose dry completely before compressing it for storage.

Those of ordinary skill in the art will devise various ways to implement the invention, and those falling within the scope of the claims hereof and their equivalents are deemed to be within the scope of the present invention.

What is claimed is:

1. A cleaning and storage implement for cleaning and storing sewer hoses used to discharge the contents of holding tanks of recreational vehicles comprising an elongated plastic tube having a length and first and second ends, with a water supply conduit fitting on said first end and a nozzle that sprays in a conical spray pattern on said second end, an adjustably positionable stop on said tube near said first end if the form of a disk having a hole sized so as to receive said tube in an adjustable friction fit, a hand grip on said tube between said fitting and said stop, and a retainer hook on said tube near said second end, whereby a compressible hose may be cleaned and stored by connecting a cleaning water supply conduit to said first end of said tube, supplying water through said tube from the supply while passing said second end of said tube into a first end of a hose to be cleaned to clean the hose by a spray of water from said water outlet, compressing the hose against said stop, and upon compressing the hose to length comparable to the distance between said stop and said retainer, retaining the second end of the hose with said retainer hook.

2. A compressible hose cleaning and storage implement comprising an elongated tube having a length and first and second ends, with a water supply conduit fitting on said first end and a water outlet on said second end, a stop on said tube near said first end and a retainer on said tube near said second end, whereby a compressible hose may be cleaned by connecting a cleaning water supply conduit to said first end of said tube, and supplying water through said tube from the supply while passing said second end of said tube with said retainer thereon into a first end of a hose to be cleaned so that the hose is circumferentially disposed radially outward of said tube to clean the hose by a spray of water from said water outlet, and wherein said stop on said tube near said first end is radially large enough to prevent a circumferentially disposed hose from passing, and said retainer on said tube near said second end is radially large enough to retain the circumferentially disposed hose, but radially small enough to let the hose pass, depending on the axial alignment of the hose with said tube at said retainer, whereby the hose may be stored by compressing the hose against said stop, and upon compressing the hose to a length comparable to the distance between said stop and said retainer, retaining the second end of the hose with said retainer.

3. A compressible hose cleaning and storage implement as claimed in claim 2 wherein said tube is a plastic tube.

4. A compressible hose cleaning and storage implement as claimed in claim 3 wherein said stop is a disk having a hole sized so as to receive said tube in an adjustable friction fit, and said water outlet is a nozzle that sprays in a conical spray pattern.

5. A compressible hose cleaning and storage implement as claimed in claim 2 wherein said tube has a hand grip between said fitting and said stop.

6. A compressible hose cleaning and storage implement as claimed in claim 2 wherein said stop is adjustably positionable.

7. A compressible hose cleaning and storage implement as claimed in claim 6 wherein said stop is a disk having a hole sized so as to receive said tube in an adjustable friction fit.

8. A compressible hose cleaning and storage implement as claimed in claim 6 wherein said stop is a disk having a hole sized so as to receive said tube in an adjustable friction fit and said retainer is a hook.

9. A compressible hose cleaning and storage implement as claimed in claim 2 wherein said water outlet is a nozzle that sprays in a conical spray pattern.

10. A compressible hose cleaning and storage implement as claimed in claim 2 wherein said retainer is a hook.

11. A compressible hose cleaning and storage implement as claimed in claim 2 wherein said tube is a plastic tube and has a hand grip between said fitting and said stop.

12. A compressible hose cleaning and storage implement as claimed in claim 2 wherein said stop is adjustably positioned and said water outlet is a nozzle that sprays in a conical spray pattern.

13. A compressible hose cleaning and storage implement as claimed in claim 2 wherein said tube is a plastic tube, and said stop is adjustable positionable.

14. A compressible hose cleaning and storage implement as claimed in claim 2 wherein said tube has a hand grip between said fitting and said stop, and said retainer is a hook.

15. A compressible hose cleaning and storage implement as claimed in claim 2 wherein said tube is a plastic tube and said retainer is a hook.

16. A compressible hose cleaning and storage implement as claimed in claim 2 wherein said stop is adjustably positionable and said tube has a hand grip between said fitting and said stop.

17. A compressible hose cleaning and storage implement as claimed in claim 2 wherein said water outlet is a nozzle that sprays in a conical spray pattern.

* * * * *